US010691047B2

(12) United States Patent
Katakura

(10) Patent No.: US 10,691,047 B2
(45) Date of Patent: Jun. 23, 2020

(54) IMAGE FORMING APPARATUS AND IMAGE FORMING METHOD FOR PROCESSING DIFFERENT FIXING TEMPERATURES OF DIFFERENT TONERS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroshi Katakura, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/546,346

(22) Filed: Aug. 21, 2019

(65) Prior Publication Data

US 2019/0377288 A1 Dec. 12, 2019

Related U.S. Application Data

(63) Continuation of application No. 15/452,805, filed on Mar. 8, 2017, now Pat. No. 10,423,102.

(30) Foreign Application Priority Data

Jul. 22, 2016 (JP) ..... 2016-144729

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/6585* (2013.01); *G03G 2215/209* (2013.01)

(58) Field of Classification Search
CPC ..... G03G 15/2039; G03G 15/2078; G03G 15/205; G03G 15/6585; G03G 2215/209
See application file for complete search history.

(56) References Cited

U.S. PATENT DOCUMENTS

| | | | |
|---|---|---|---|
| 9,134,668 | B2 | 9/2015 | Ogasawara |
| 9,285,731 | B1 | 3/2016 | Katakura |
| 2012/0321350 | A1 | 12/2012 | Ogasawara |
| 2014/0193168 | A1 | 7/2014 | Kimoto |

OTHER PUBLICATIONS

Non-Final Office Action for U.S. Appl. No. 15/452,805, dated Apr. 18, 2018.
Final Office Action for U.S. Appl. No. 15/452,805, dated Oct. 19, 2018.
Final Office Action for U.S. Appl. No. 15/452,805, dated Nov. 20, 2018.

*Primary Examiner* — David M. Gray
*Assistant Examiner* — Laura Roth
(74) *Attorney, Agent, or Firm* — Amin, Turocy & Watson, LLP

(57) ABSTRACT

In accordance with an embodiment, an image forming apparatus comprises an image forming section, a fixing section and a controller. The image forming section forms a toner image with at least one selected from a first toner having a first fixing temperature area and a second toner having a second fixing temperature area of which a lower limit fixing temperature is higher than the first toner. The fixing section fixes the toner image on the sheet. The controller controls a standby temperature of the fixing section to a temperature lower than the lower limit fixing temperature of the second fixable temperature area.

17 Claims, 6 Drawing Sheets

IMAGE FORMING APPARATUS AND IMAGE FORMING METHOD FOR PROCESSING DIFFERENT FIXING TEMPERATURES OF DIFFERENT TONERS

CROSS-REFERENCE TO RELATED APPLICATIONS

This application is a Continuation of application Ser. No. 15/452,805 filed on Mar. 8, 2017, the entire contents of which are incorporated herein by reference.

This application is based upon and claims the benefit of priority from Japanese Patent Application No. 2016-144729, filed Jul. 22, 2016, the entire contents of which are incorporated herein by reference.

FIELD

Embodiments described herein relate generally to an image forming apparatus and methods associated therewith.

BACKGROUND

An image forming apparatus capable of forming an image with a decoloring toner and a non-decoloring toner is proposed. A temperature area in which a toner image by the decoloring toner can be fixed on a sheet and a temperature area in which a toner image by the non-decoloring toner can be fixed on the sheet are different. For example, if the toner image by the decoloring toner is fixed at a fixable temperature of the non-decoloring toner, the toner image fixed on the sheet may be erased in some cases. Thus, it is necessary for the image forming apparatus to control a temperature of a fixing section according to the type of toner used.

The image forming apparatus cannot determine which toner is used until receiving a print job. Thus, for example, in a case in which the temperature of the fixing device on standby is set to a temperature suitable to one toner, at the time of receiving the print job requiring use of the other toner, there is a problem that waiting time is generated for adjusting the temperature.

DETAILED DESCRIPTION

In accordance with an embodiment, an image forming apparatus comprises an image forming section, a fixing section and a controller. The image forming section forms a toner image with at least one toner selected from a first toner having a first fixing temperature area and a second toner having a second fixing temperature area of which a lower limit fixing temperature is higher than the first toner. The fixing section fixes the toner image on the sheet. The controller controls a standby temperature of the fixing section to a temperature lower than the lower limit fixing temperature of the second fixable temperature area.

In accordance with an embodiment, the image forming apparatus can suppress and/or reduce waiting time generated at the time of receiving a job. Hereinafter, the image forming apparatus of the embodiment is described in detail.

Figure 1:
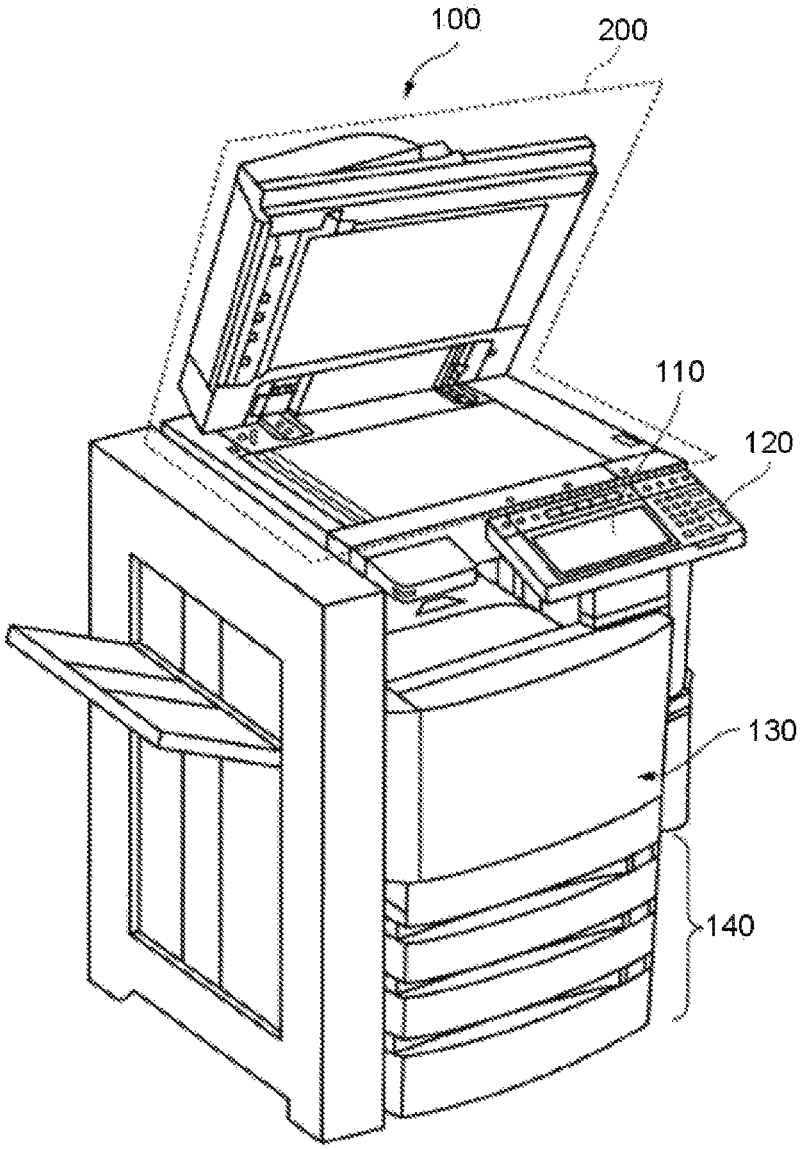
FIG. 1 is an external view exemplifying the overall constitution of an image forming apparatus 100 according to an embodiment.

FIG. 1 is an external view illustrating an example of the overall constitution of an image forming apparatus 100 according to the embodiment. The image forming apparatus 100 is, for example, a multi-function peripheral. The image forming apparatus 100 is provided with a display 110, a control panel 120, a printer section 130, a sheet housing section 140 and an image reading section 200.

The image forming apparatus 100 forms an image on a sheet with a developing agent such as a toner. The sheet is, for example, a paper, a label paper and the like. The sheet may be an optional object as long as the image forming apparatus 100 can form an image on the surface thereof.

The display 110 is an image display device such as a liquid crystal display, an organic EL (Electro Luminescence) display and the like. The display 110 displays various information relating to the image forming apparatus 100.

The control panel 120 includes a plurality of buttons. The control panel 120 receives an operation by the user. The control panel 120 outputs a signal in response to the operation executed by the user to the controller of the image forming apparatus 100. Further, the display 110 and the control panel 120 may be integrally configured as a touch panel.

The printer section 130 forms an image on the sheet based on image information generated by the image reading section 200 or image information received via a communication path. The printer section 130 forms an image by the following processing. An image forming section of the printer section 130 forms an electrostatic latent image on the photoconductive drum based on the image information. The image forming section of the printer section 130 forms a visible image by attaching the developing agent to the electrostatic latent image. The transfer section of the printer section 130 transfers the visible image onto the sheet. A fixing section of the printer section 130 fixes the visible image on the sheet by applying heat and pressure to the sheet. The sheet on which the image is formed is a sheet housed in the sheet container 140 or a sheet that is manually fed.

The sheet housing section 140 houses the sheet used for the image formation in the printer section 130.

The image reading section 200 reads the image information serving as a reading object as the intensity of light. The image reading section 200 records the read image information. The recorded image information may be sent to another information processing apparatus via a network. The recorded image information may be used to form an image on the sheet by the printer section 130.

Figure 2:
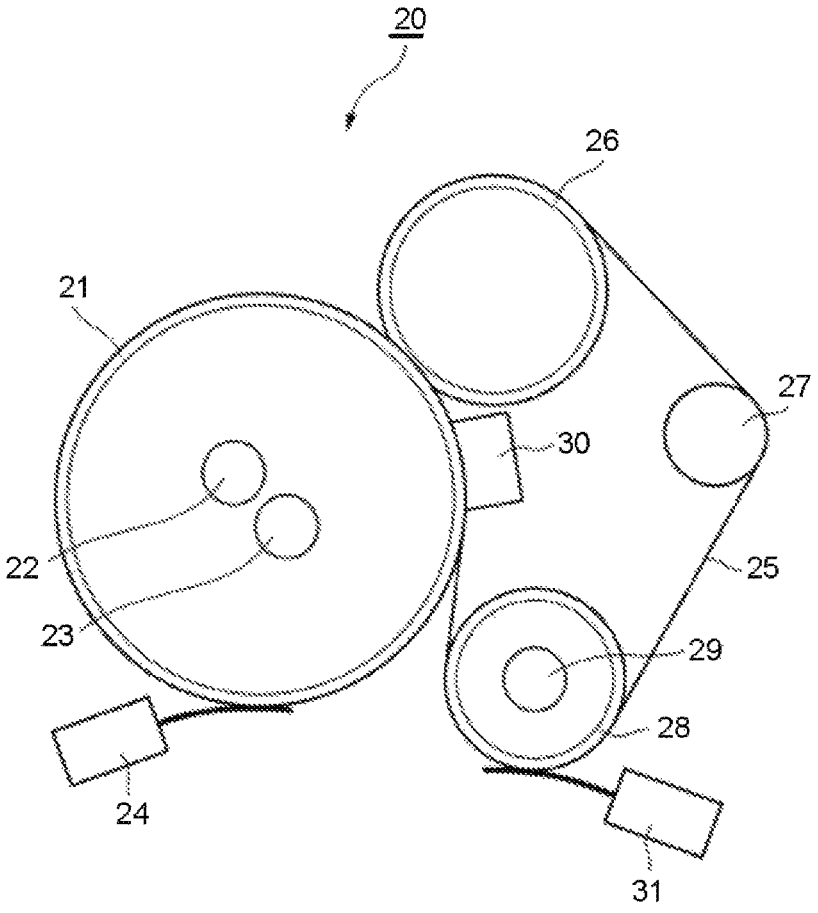
FIG. 2 is a section view illustrating the schematic constitution of a fixing device 20.

FIG. 2 is a section view illustrating the schematic constitution of a fixing device 20 provided in the printer section 130 shown in FIG. 1. The fixing device 20 can fix a toner image by the non-decoloring toner and a toner image by the decoloring toner on the sheet. The fixing device 20 includes a heat roller (fixing roller) 21, an HR center lamp 22, an HR side lamp 23, an HR thermistor (fixing roller thermistor) 24, a pressure belt 25, an output pressure roller 26, a tension roller 27, a pressure belt heat roller 28, a pressure belt lamp 29, a nip pad 30 and a pressure belt thermistor 31.

The heat roller 21 is a concrete example of a heating section. The heat roller 21 is heated by a built-in heat generation body. The heat roller 21 includes the HR center lamp 22 and the HR side lamp 23 therein. The HR center lamp 22 is a concrete example of a first heat generation body. The HR side lamp 23 is a concrete example of a second generation body. The heat roller 21 has a substratum made of aluminum having a thickness of 1.0 mm. The outer peripheral surface of the heat roller 21 is covered with a releasing layer. The release layer is a fluorine-coated layer. The release layer may be an elastic layer, a PFA (tetrafluoroethylene perfluoroalkyl vinyl ether copolymer) tube and the like. The heat roller 21 is, for example, a roller (cylindrical rotating object) with a diameter of 45 mm.

The HR center lamp 22 and the HR side lamp 23 are, for example, heating sources such as halogen lamps. Further, the consumed power by the HR center lamp 22 and the HR side lamp 23 is 600 W in total.

The HR center lamp 22 heats a center part in a longitudinal direction of the heat roller 21.

The HR side lamp 23 heats end part in the longitudinal direction of the heat roller 21. The HR thermistor 24 detects the temperature of the heat roller 21.

The pressure belt 25 is an endless belt. The pressure belt 25 is stretched over the output pressure roller 26, the tension roller 27 and the pressure belt heat roller 28. The pressure belt 25 is, for example, a belt with a diameter of 50 mm.

The output pressure roller 26 has, for example, a diameter of 21 mm. Solid rubber having a thickness of 2 mm is fastened around a core of SUS (Stainless Used Steel) with a diameter of 17 mm in the output pressure roller 26. The pressure belt 25 is pressed by a pressure mechanism (not shown) to press abutting parts of the heat roller 21 and the output pressure roller 26 at 290 N.

The tension roller 27 applies a tension to the pressure belt 25. The tension roller 27 has, for example, a diameter of 10 mm. The tension roller 27 is constituted by coating a PFA tube having a thickness of 50 μm on the outer circumference of the SUS.

The pressure belt heat roller 28 is heated by a built-in heat generation body. The pressure belt heat roller 28 is a concrete example of a pressure section. The pressure belt heat roller 28 includes a pressure belt lamp 29 therein as the heat generation body. The pressure belt lamp 29 is a concrete example of a third heat generation body. The pressure belt heat roller 28 has, for example, a diameter of 17 mm. The pressure belt heat roller 28 has a substratum made of aluminum having a wall thickness of 1.0 mm, for example. The surface of the pressure belt heat roller 28 may be covered with the releasing layer. The releasing layer is provided to improve releasability between the toner and the surface layer of the pressure belt heat roller 28. The releasing layer is, for example, a layer composed of fluororesin, silicone rubber and the like.

The pressure belt lamp 29 heats the pressure belt heat roller 28. The pressure belt 25 is heated by transmitting the heat from the heated pressure belt heat roller 28. The pressure belt lamp 29 is a heating source such as a halogen lamp, for example. In the concrete example shown in FIG. 2, the pressure belt lamp 29 is a halogen lamp of which the consumed power is 300 W.

The nip pad 30 presses the pressure belt 25 towards an outer peripheral surface of the heat roller 21 with a pressure mechanism (not shown) independent of the inner side of the pressure belt 25. The pressure belt 25 and the heat roller 21 are pressed to each other by the nip pad 30. The nip pad 30 is a prismatic shape member having a width of 8.4 mm for example. The nip pad 30 is constituted by, for example, a silicone rubber having a thickness of 3.5 mm laminated on an auxiliary sheet metal. Between the nip pad 30 and the pressure belt 25, a sliding sheet for friction reduction may be provided.

The pressure belt thermistor 31 detects the temperature of the pressure belt 25. The pressure belt thermistor 31 is arranged at a center part in a width direction of the pressure belt 25.

The sheet and the toner image on the sheet pass through a nip between the heat roller 21 and the pressure belt 25 to be heated and pressurized. The sheet passing through the nip is heated from two sides of the heat roller 21 and the pressure belt 25. In this way, the toner image is fixed on the sheet.

Figure 3:
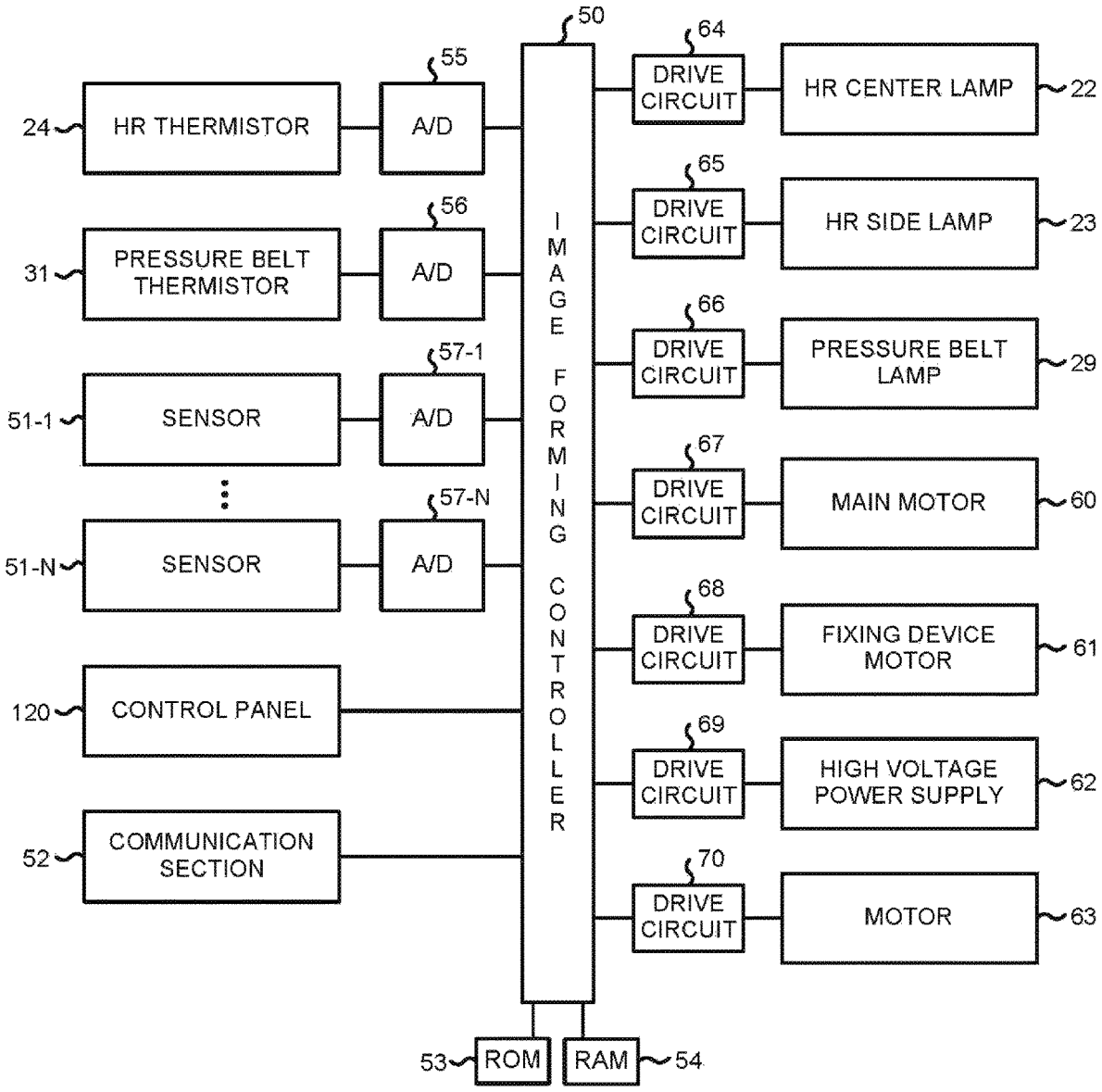
FIG. 3 is a block diagram illustrating functional components of the image forming apparatus 100 according to the embodiment.

FIG. 3 is a block diagram illustrating functional components of the image forming apparatus 100 according to the embodiment. The image forming apparatus 100 includes an image forming controller 50, sensors 51-1~51-N (N is an integer greater than or equal to 1), a communication section 52, a ROM 53, a RAM 54, an A/D (analog digital) converters 55-56, A/D converters 57-1~57-N, a main motor 60, a fixing device motor 61, a high voltage power supply 62, a motor 63, and drive circuits 64~70 in addition to the control panel 120, the HR center lamp 22, the HR side lamp 23, the HR thermistor 24, the pressure belt lamp 29, the pressure belt thermistor 31.

Hereinafter, at the time of not distinguishing which sensor it is, the sensor is simply referred to as the sensor 51. At the time of not distinguishing which A/D converter it is among the A/D converters 57-1~57-N, the A/D converter is simply referred to as the A/D converter 57.

The image forming controller 50 has a CPU (Central Processing Unit). The image forming controller 50 controls the image forming apparatus including a temperature control of the fixing device 20.

Input devices connected with the image forming controller 50 are the HR thermistor 24, the pressure belt thermistor 31, the sensor 51, the control panel 120 and the communication section 52. Output devices connected to the image forming controller 50 are the HR center lamp 22, the HR side lamp 23, the pressure belt lamp 29, the main motor 60, the fixing device motor 61, the high voltage power supply 62 and the motor 63.

First, the input devices connected to the image forming controller 50 are described below.

The HR thermistor 24 outputs a signal to the image forming controller 50 via the A/D converter 55. The HR thermistor 24 outputs a signal indicating a surface temperature of the heat roller 21 to the image forming controller 50.

The pressure belt thermistor 31 outputs a signal to the image forming controller 50 via the A/D converter 56. The pressure belt thermistor 31 outputs a signal indicating a surface temperature of the pressure belt 25 to the image forming controller 50.

The sensor 51 measures a physical quantity for controlling the image formation. The sensor 51 outputs a signal indicating the measured physical quantity to the image forming controller 50 via the A/D converter 57.

The control panel 120 outputs a signal indicating an instruction from a user received by the control panel 120 to the image forming controller 50. For example, the control panel 120 outputs a printing instruction by the user. In this case, the image forming controller 50 forms an image according to the printing instruction by the user.

The communication section 52 carries out communication with an external device. The communication section 52 may communicate with the external device in a wired manner or a wireless manner. The external device is, for example, an information terminal such as a computer. The communication section 52 receives a signal indicating an instruction by the user to output the signal to the image forming controller 50.

Next, the output devices connected to the image forming controller 50 are described.

The image forming controller 50 controls the operation of the HR center lamp 22 with the drive circuit 64. The image forming controller 50 controls the temperature of the heat roller 21 by controlling lighting time of the HR center lamp 22, for example.

The image forming controller 50 controls the operation of the HR side lamp 23 with the drive circuit 65. The image forming controller 50 controls the temperature of the heat roller 21 by controlling lighting time of the HR side lamp 23, for example. The image forming controller 50 may control the temperature of the heat roller 21 by controlling electric energy of the HR side lamp 23.

The image forming controller 50 controls the operation of the pressure belt lamp 29 with the drive circuits 66. The image forming controller 50 controls the temperature of the pressure belt 25 by controlling lighting time of the pressure belt lamp 29, for example.

The image forming controller 50 controls the operation of the main motor 60 with the drive circuit 67. The image forming controller 50 controls the operation of the fixing device motor 61 with the drive circuit 68. The image forming controller 50 controls the operation of the high voltage power supply 62 with the drive circuit 69. The image forming controller 50 controls the operation of the motor 63 with the drive circuits 70.

Each of the drive circuits 64~70 is constituted by any one of a switching circuit, a D/A (digital analog) converter and the like.

The main motor 60 rotationally drives a photoconductive drum proved in the printer section 130 with a drive mechanism. The fixing device motor 61 rotationally drives the heat roller 21 with a drive mechanism.

The high voltage power supply 62 and the motor 63 operate to form an image. In FIG. 3, one high voltage power supply 62 and one motor 63 are shown; however, a plurality of high voltage power supplies 62 and a plurality of motors 63 may be arranged.

The ROM 53 is connected with the image forming controller 50. The ROM 53 stores a control program and a control data.

The RAM 54 is connected with the image forming controller 50. The RAM 54 stores control parameters and operation data of the image forming apparatus 100. The RAM 54 stores the number of printed sheets of consumable goods which is counted.

The image forming apparatus 100 of the present embodiment has the decoloring toner as the first toner and the non-decoloring toner as the second toner to form the toner image on the sheet such a paper with either toner.

Figure 4:
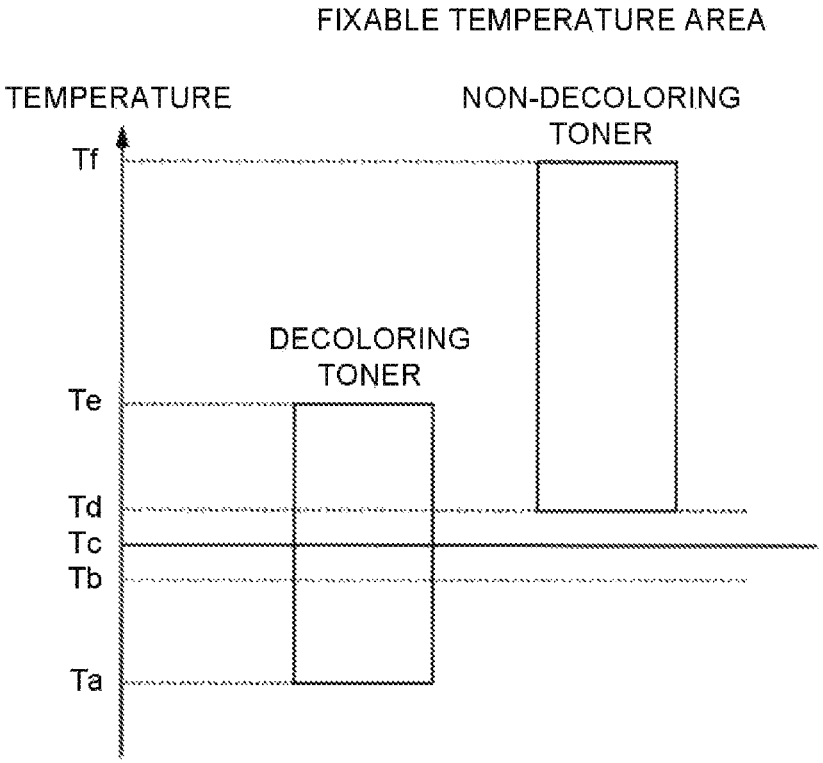
FIG. 4 is a diagram illustrating a fixable temperature area.

FIG. 4 is a diagram illustrating a fixable temperature area of each toner by the fixing device 20. Ta, Tb, Tc, Td, Te, and Tf in FIG. 4 are temperatures. As an example, Ta is 95° C., Tb is 105° C., Tc is 108° C., Td is 110° C., Te is 117° C., and Tf is 150° C.

A fixing temperature area A (that is, a temperature range) capable of fixing the decoloring toner satisfies that $Ta \leq A \leq Te$. Thus, a minimum temperature of the fixable temperature area of the decoloring toner is Ta. In a case in which the fixing temperature is smaller than Ta, image peeling occurs due to low temperature offset and insufficient fixing strength. In a case in which the fixing temperature is greater than Te, a part of the toner image fixed on the sheet is decolored and the temperature is not suitable as the fixing temperature. In fact, since Te is a boundary temperature at which the decoloring is started, Te is not often used as the fixing temperature; however, Te is shown as the fixable temperature as property of the toner.

A fixing temperature area B capable of fixing the non-decoloring toner meets that $Td \leq B \leq Tf$. Thus, the minimum temperature of the fixable temperature area of the non-decoloring toner is Td. In a case in which the fixing temperature is smaller than Td, image peeling occurs due to the low temperature offset and the insufficient fixing strength. In a case in which the fixing temperature is greater than Tf, high temperature offset occurs. The lower limit fixing temperature is measured by the following method.

The fixing system was modified so that the set temperature can be incremented or decremented by 0.1 degree centigrade between 100 degrees centigrade and 200 degrees centigrade. The initial temperature was set to 150 degrees centigrade, and a solid image at a toner deposition amount of 1.5 mg/cm2 was formed on 10 sheets of paper. When not the slightest image peeling due to offset or an unfixed toner occurred on the 10 sheets of paper, the set temperature was decreased, and the lower limit of the fixing temperature at which image peeling did not occur was determined. As shown in FIG. 4, there is a great difference in the lower limit fixing temperatures (Ta, Td) of the fixing temperature areas of the plurality of toners, in the present embodiment, there is a difference of 15° C. (=Td−Ta)° C. Due to this, there is great difference in set fixing temperatures for fixing the toner. In the present embodiment, the set fixing temperature of the decoloring toner is 102° C., and the set fixing temperature of the non-decoloring toner is 120° C. At this time, in a case of setting a standby temperature nearby the set fixing temperature of the non-decoloring toner, the consumed power at the time of standby is large. At the time a print job with the decoloring toner is received as a next job on standby, as it takes time to lower the temperature of the fixing device 20 under the influence of a heat storage property of the fixing device 20, there is a problem that it takes much time until first copy.

In the present embodiment, the standby temperature is equal to or smaller than the lower limit fixing temperature (Td) of the non-decoloring toner. The standby temperature includes temperature at which the fixing device is maintained during the time for waiting a new printing job.

By controlling the standby temperature to a temperature (Tc) slightly lower than the lower limit fixing temperature (Td) of the non-decoloring toner, even at the time the print job with the non-decoloring toner is received, the supply power of the fixing device 20 rises, and it is possible to quickly execute the printing with the non-decoloring toner. In one embodiment, the printing is executed within 3 seconds of receiving the print job. In another embodiment, the printing is executed within 2 seconds of receiving the print job. In another embodiment, the printing is executed in less than 1 second of receiving the print job.

On the other hand, at the time the print job with the decoloring toner is received, while maintaining the standby temperature (Tc), it is possible to execute the print job with the decoloring toner. The reason is that the fixing of the decoloring toner can be executed without problems even in a state in which the temperature of the fixing device 20 is higher than the set fixing temperature as the standby temperature (Tc) is within the fixing temperature area of the decoloring toner and the heat of the fixing device 20 is deprived by the sheet and the like to fall at the time of starting printing.

At this time, it is desired that the lower limit fixing temperature (Td) of the non-decoloring toner is sufficiently lower than the upper limit fixing temperature (Te) of the decoloring toner. If the lower limit fixing temperature (Td) of the non-decoloring toner is sufficiently low, the standby temperature can be sufficiently lower than the upper limit fixing temperature (Te) of the decoloring toner. Thus, even if there is a case in which the temperature of the fixing device is gradually increased and the printing with the decoloring toner is continuously executed, it is difficult to reach the decoloring temperature.

It is necessary that the difference between the standby temperature Tc and the upper limit fixing temperature (Te) of the decoloring toner is 3° C. or greater, preferably 5° C. or greater, and further preferably 7° C. or greater.

From the above viewpoint, a temperature area C which is common (overlapped) for the fixable temperature areas of the plurality of toners is that $Td \leq C \leq Te$. The temperature range is 2° C. or greater, preferably 4° C. or greater, and further preferably 6° C. or greater. Considering restrictions on the physical property of the toner, a region width of the temperature area C is 15° C. or less.

A temperature area D ($Tb \leq D < Td$) is described. The temperature area is an area in which the image forming controller 50 can heat the temperature of the fixing device 20 to a temperature equal or greater than the lower limit fixing temperature (Td) of the non-decoloring toner from a moment the job is received to a moment the sheet arrives at the fixing device 20. In the present embodiment, the standby temperature of the fixing section 20 is controlled to Tc within the temperature area D. Tc is smaller than Td which is the maximum temperature. Tc is a temperature capable of fixing the toner image by the decoloring toner.

Further, if the standby temperature is equal to or greater than Te, in a case of receiving a job using the non-decoloring toner (hereinafter, referred to as a "non-decoloring job"), waiting time is not generated. However, in a case of receiving a job using the decoloring toner (hereinafter, referred to as a "decoloring job"), time is necessary to lower the temperature of the fixing device 20. The time required for lowering the temperature is longer than the time required for increasing the temperature, and thus, in a case in which the decoloring job is received, the waiting time is generated.

In a case in which the standby temperature is smaller than Tb, as the image forming controller 50 cannot heat the temperature of the fixing device 20 to a temperature equal to or greater than Td until the sheet reaches the fixing device 20, the waiting time is generated.

In a case in which the standby temperature is set to a temperature within the temperature area C which is common for the fixable temperature area, the waiting time is not generated even in both the non-decoloring job and the decoloring job. However, the consumed power amount on standby is greater than that in a case in which the standby temperature is controller at Tc.

Through the above, from the viewpoint of the waiting time and the consumed power, it is optimum that the standby temperature is greater than or equal to Tb and equal to or smaller than Td.

Figure 5:
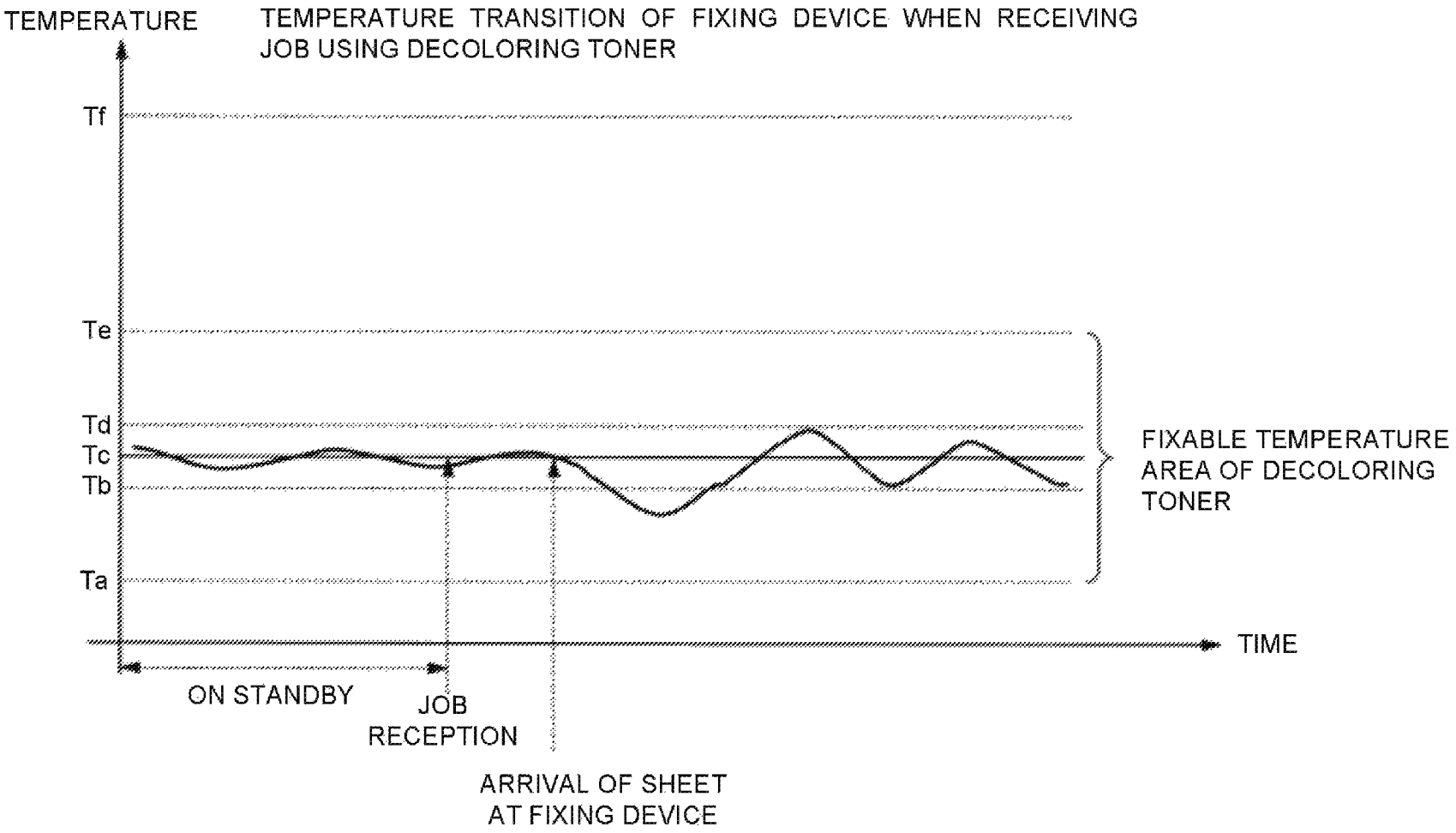
FIG. 5 is a diagram illustrating a temperature transition of the fixing device 20 at the time of receiving a decoloring job.

FIG. 5 is a diagram illustrating a temperature transition of the fixing device 20 on standby at the time of receiving the decoloring job. The image forming controller 50 controls the standby temperature of the fixing section 20 on standby to Tc. If receiving the decoloring job, the image forming controller 50 controls the toner image by the decoloring toner to the fixable temperature, and thus the waiting time for adjusting the temperature is not generated. Further, if the sheet reaches the fixing device 20, the heat is deprived by the sheet, and the temperature of the fixing device 20 goes up and down.

Figure 6:
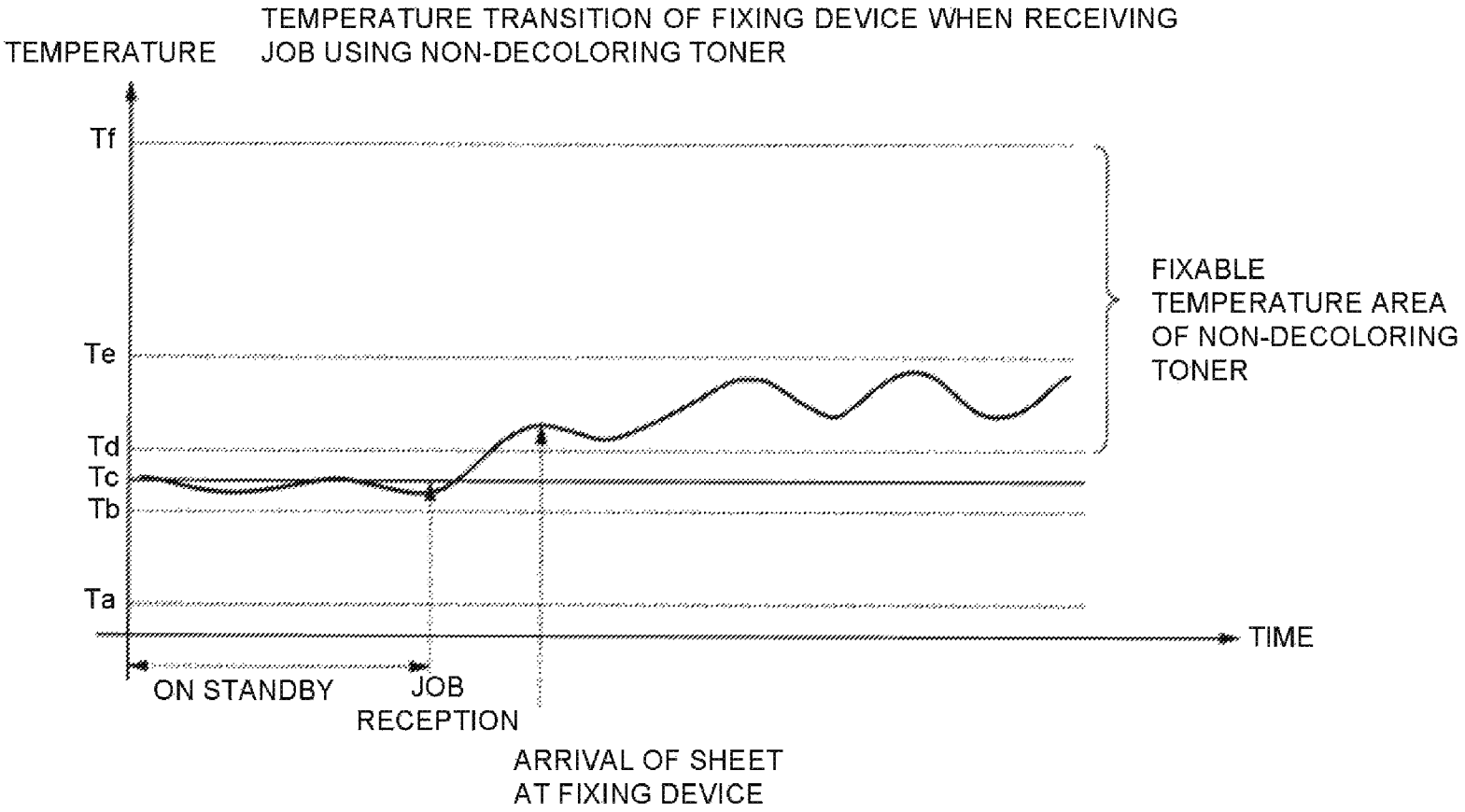
FIG. 6 is a diagram illustrating a temperature transition of the fixing device 20 at the time of receiving a non-decoloring job.

FIG. 6 is a diagram illustrating a temperature transition of the fixing device 20 on standby at the time of receiving the non-decoloring job. The image forming controller 50 controls the standby temperature of the fixing section 20 on standby to Tc. As stated above, Tc which is the temperature of the fixing section 20 on standby is a temperature that can be heated to Td which is the maximum temperature from a moment the job is received on standby to a moment the sheet arrives at the fixing section 20.

If receiving the non-decoloring job on standby, the image forming controller 50 heats the fixing device 20. The sheet is fed from the tray to reach the fixing section 20 after subjected to the image formation. Meanwhile, the temperature of the fixing device 20 is equal to or greater than Td. Thus, the waiting time for adjusting the temperature is not generated. Further, if the sheet reaches the fixing device 20, as the heat is deprived by the sheet, the temperature of the fixing device 20 goes up and down.

Through the above, in a case of receiving the job on standby, even for the job using either toner, the waiting time for adjusting the temperature is not generated.

In accordance with the image forming apparatus of the embodiment described above, it is possible to suppress the waiting time generated at the time of receiving the job.

Furthermore, in the present embodiment, the decoloring toner as the first toner and the non-decoloring toner as the second toner are described as examples; however, the toner may be any toner as long as the toner has different fixing temperature areas.

The functions of the image forming apparatus according to the foregoing embodiment may be realized by a computer. In this case, programs for realizing the functions are recorded in a computer-readable recording medium and the functions may be realized by reading programs recorded in the recording medium into a computer system and executing the programs. Further, it is assumed that the "computer system" described herein contains an OS or hardware such as peripheral devices. Further, the "computer-readable recording medium" refers to a portable medium such as a flexible disc, a magneto-optical disk, a ROM, a CD-ROM and the like and a storage device such as a hard disk built in the computer system. Furthermore, the "computer-readable recording medium" may contain a medium for dynamically holding the programs for a short time like a communication wire in a case in which the programs are sent via a communication line such as a network such as the internet or a telephone line or a medium for holding the programs for a certain time like a volatile memory in the computer system serving as a server and a client. The foregoing programs may realize a part of the above-mentioned functions or may realize the above-mentioned functions with the combination of the programs already recorded in the computer system.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image forming section configured to form a toner image with at least one selected from a first toner having a first fixing temperature range and a second toner having a second fixing temperature range, the first toner different from the second toner, the second fixing temperature range having a second lower limit fixing temperature of the second toner that is higher than a first lower limit fixing temperature of the first fixing temperature range of the first toner;

a fixing section configured to fix the toner image on a sheet with at least one selected from the first toner and the second toner; and a controller configured to control a standby temperature of the fixing section to a temperature lower than the second lower limit fixing temperature of the second fixing temperature range of the second toner, wherein the standby temperature is configured to be heated to a temperature greater than or equal to the second lower limit fixing temperature of the second fixing temperature range within 3 seconds from when a job is received on standby to a moment the sheet arrives at the fixing section.

2. The image forming apparatus according to claim 1, wherein a range of a temperature range which is common for the first fixing temperature range and the second fixing temperature range is greater than or equal to 2° C. and equal to or smaller than 15° C.

3. The image forming apparatus according to claim 1, wherein a difference between an upper limit fixing temperature of the first fixing temperature range and the standby temperature is greater than or equal to 3° C.

4. The image forming apparatus according to claim 1, wherein the first toner is a decoloring toner.

5. The image forming apparatus according to claim 1, wherein the second toner is a non-decoloring toner.

6. The image forming apparatus according to claim 1, wherein a range of a temperature range which is common for the first fixing temperature range and the second fixing temperature range is greater than or equal to 4° C. and equal to or smaller than 15° C.; and a difference between an upper limit fixing temperature of the first fixing temperature range and the standby temperature is greater than or equal to 5° C.

7. The image forming apparatus according to claim 1, wherein the standby temperature is configured to be heated to a temperature greater than or equal to the second lower limit fixing temperature of the second fixing temperature range less than the 1 second from when a job is received on standby until a moment the sheet arrives at the fixing section.

8. An image forming apparatus, comprising:

an image forming section configured to form a toner image with at least one selected from a decoloring toner having a first fixing temperature range and a non-decoloring toner having a second fixing temperature range, the decoloring toner different from the non-decoloring toner, the second fixing temperature range having a second lower limit fixing temperature that is higher than a first lower limit fixing temperature of the first fixing temperature range;

a fixing section configured to fix the toner image on a sheet with at least one selected from the decoloring toner and the non-decoloring toner; and a controller configured to control a standby temperature of the fixing section to a temperature lower than the second lower limit fixing temperature of the second fixing temperature range of the second toner, wherein the standby temperature is configured to be heated to a temperature greater than or equal to the second lower limit fixing temperature of the second fixing temperature range within 3 seconds from when a job is received on standby to a moment the sheet arrives at the fixing section.

9. The image forming apparatus according to claim 8, wherein a range of a temperature range which is common for the first fixing temperature range and the second fixing temperature range is greater than or equal to 2° C. and equal to or smaller than 15° C.

10. The image forming apparatus according to claim 8, wherein a difference between an upper limit fixing temperature of the first fixing temperature range and the standby temperature is greater than or equal to 3° C.

11. The image forming apparatus according to claim 8, wherein the standby temperature is configured to be heated to a temperature greater than or equal to the second lower limit fixing temperature of the second fixing temperature range within 2 seconds from when a job is received on standby to a moment the sheet arrives at the fixing section.

12. An image forming method, comprising:

forming a toner image with at least one selected from a first toner having a first fixing temperature range and a second toner having a second fixing temperature range, the first toner different from the second toner, the second fixing temperature range of the second toner having a second lower limit fixing temperature that is higher than a first lower limit fixing temperature of the first fixing temperature range of the first toner;

fixing the toner image on a sheet with at least one selected from the first toner and the second toner;

keeping a standby temperature of a fixing section to a temperature lower than the second lower limit fixing temperature of the second fixing temperature range of the second toner; and raising the standby temperature to a temperature greater than or equal to the second lower limit fixing temperature of the second fixing temperature range within 3 seconds from when a job is received on standby until a moment the sheet arrives at the fixing section.

13. The image forming method according to claim 12, wherein a range of a temperature range which is common for the first fixing temperature range and the second fixing temperature range is greater than or equal to 2° C. and equal to or smaller than 15° C.

14. The image forming method according to claim 12, wherein a difference between an upper limit fixing temperature of the first fixing temperature range and the standby temperature is greater than or equal to 3° C.

15. The image forming method according to claim 12, wherein the first toner is a decoloring toner.

16. The image forming method according to claim 12, wherein the second toner is a non-decoloring toner.

17. The image forming method according to claim 12, further comprising raising the standby temperature to a temperature greater than or equal to the second lower limit fixing temperature of the second fixing temperature range within 1 second from when a job is received on standby until a moment the sheet arrives at the fixing section.

* * * * *